US011007449B2

(12) United States Patent
Chen

(10) Patent No.: US 11,007,449 B2
(45) Date of Patent: May 18, 2021

(54) SINGLE SHEET FABRIC APPAREL SET FOR A DOLL

(71) Applicant: Hsiang-Jung Chen, Shetou Township, Changhua County (TW)

(72) Inventor: Hsiang-Jung Chen, Shetou Township, Changhua County (TW)

( * ) Notice: Subject to any disclaimer, the term of this patent is extended or adjusted under 35 U.S.C. 154(b) by 0 days.

(21) Appl. No.: 16/710,673

(22) Filed: Dec. 11, 2019

(65) Prior Publication Data

US 2021/0069605 A1 Mar. 11, 2021

(30) Foreign Application Priority Data

Sep. 5, 2019 (TW) ..... 10821182.5

(51) Int. Cl.
*A63H 3/52* (2006.01)
*A63H 3/02* (2006.01)

(52) U.S. Cl.
CPC ..... *A63H 3/52* (2013.01); *A63H 3/02* (2013.01)

(58) Field of Classification Search
CPC ..... A63H 3/08; A63H 3/52
See application file for complete search history.

(56) References Cited

U.S. PATENT DOCUMENTS

| | | | | | |
|---|---|---|---|---|---|
| 1,601,393 | A * | 9/1926 | Honti | A63H 3/08 | 446/98 |
| 2,942,271 | A * | 6/1960 | Frankenfield | A63H 3/52 | 2/74 |
| 2,944,368 | A * | 7/1960 | O'Brian | A63H 3/08 | 446/98 |
| 3,783,554 | A * | 1/1974 | Shapero | A63H 3/52 | 446/87 |
| 5,194,034 | A * | 3/1993 | Heppenstall | A63H 3/52 | 2/80 |
| 6,227,930 | B1 * | 5/2001 | Norman | A63H 3/52 | 2/243.1 |
| 6,475,054 | B1 * | 11/2002 | Liu | A63H 3/10 | 446/387 |
| 2013/0171908 | A1 * | 7/2013 | Galfano | A63H 3/08 | 446/268 |

* cited by examiner

*Primary Examiner* — John A Ricci

(57) ABSTRACT

A single sheet fabric apparel set for a doll has a piece of woven fabric, the piece of woven fabric being a double layered, whole garment stretch cloth having a plurality of apparel items, and at least one dividing portion provided between two adjacent apparel items.

3 Claims, 9 Drawing Sheets

SINGLE SHEET FABRIC APPAREL SET FOR A DOLL

BACKGROUND OF INVENTION

Field of Invention

The present invention relates to a toy accessory, and more particularly to a single sheet fabric apparel set for a doll.

Description of the Related Art

Typically, the common paper dolls are mainly made of cardboard cut into a doll shape and a variety of different styles of clothing accessory items. The edge of the clothing accessory items are provided with a number of attaching pieces, and by bending the attaching piece and hanging on the paper doll the paper doll is dressed. Furthermore, the clothing accessory items can be freely replaced according to the child's preference. However, the paper dolls and the clothing accessory items are all paper products, which are prone to breakage and breakage after a certain period of time.

Therefore, it is desirable to provide a single sheet fabric apparel set for a doll to mitigate and/or obviate the aforementioned problems.

SUMMARY OF THE INVENTION

An objective of present invention is to provide a single sheet fabric apparel set for a doll, which is capable of improving the above-mention problems.

In order to achieve the above mentioned objective, A single sheet fabric apparel set for a doll has a piece of woven fabric, the piece of woven fabric being a double layered, whole garment stretch cloth having a plurality of apparel items, and at least one dividing portion provided between two adjacent apparel items.

Other objects, advantages, and novel features of invention will become more apparent from the following detailed description when taken in conjunction with the accompanying drawings.

DETAILED DESCRIPTION OF THE PREFERRED EMBODIMENT

Figure 1:
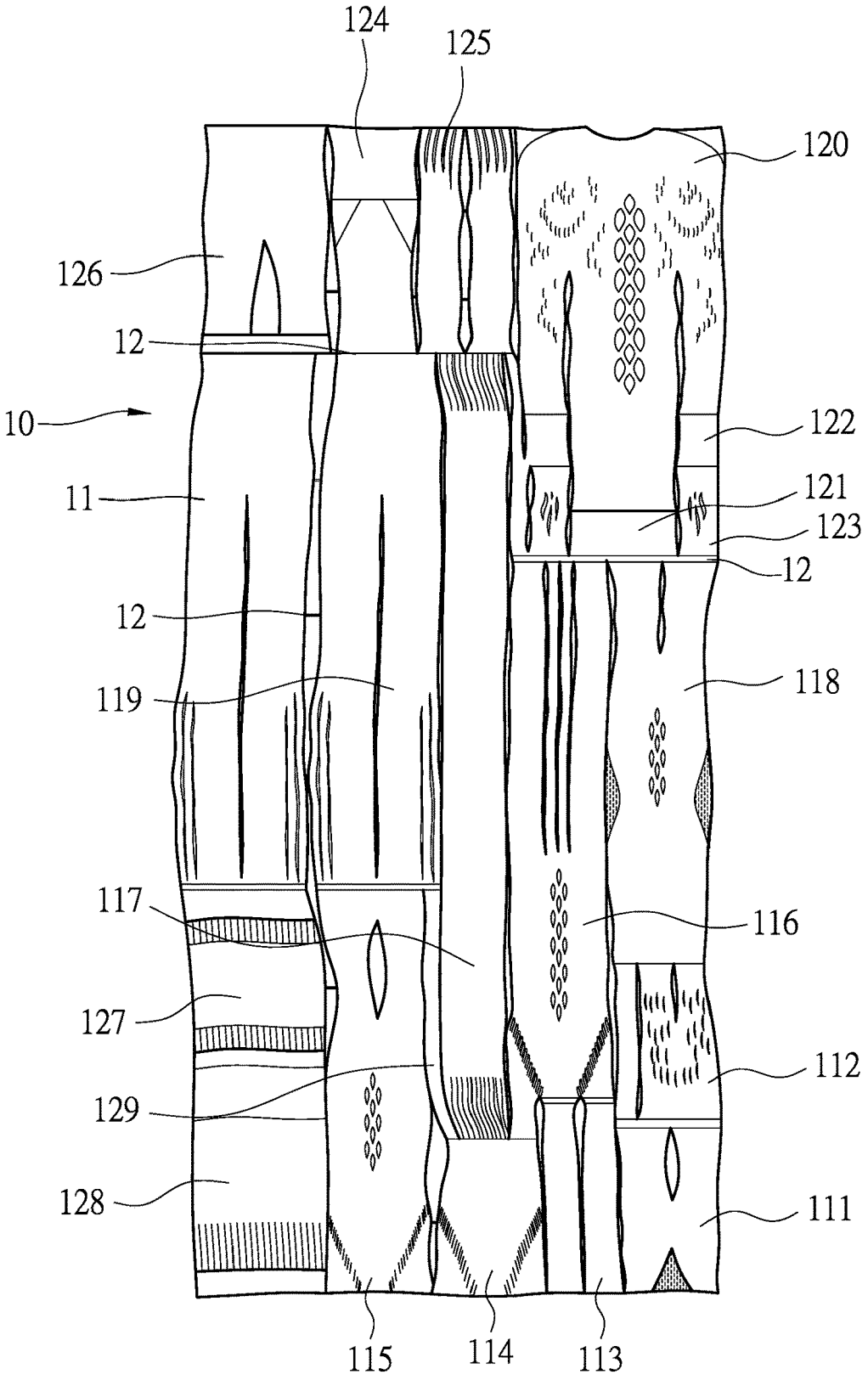
FIG. 1 is a schematic drawing of a preferred embodiment of the present invention.
Figure 2:
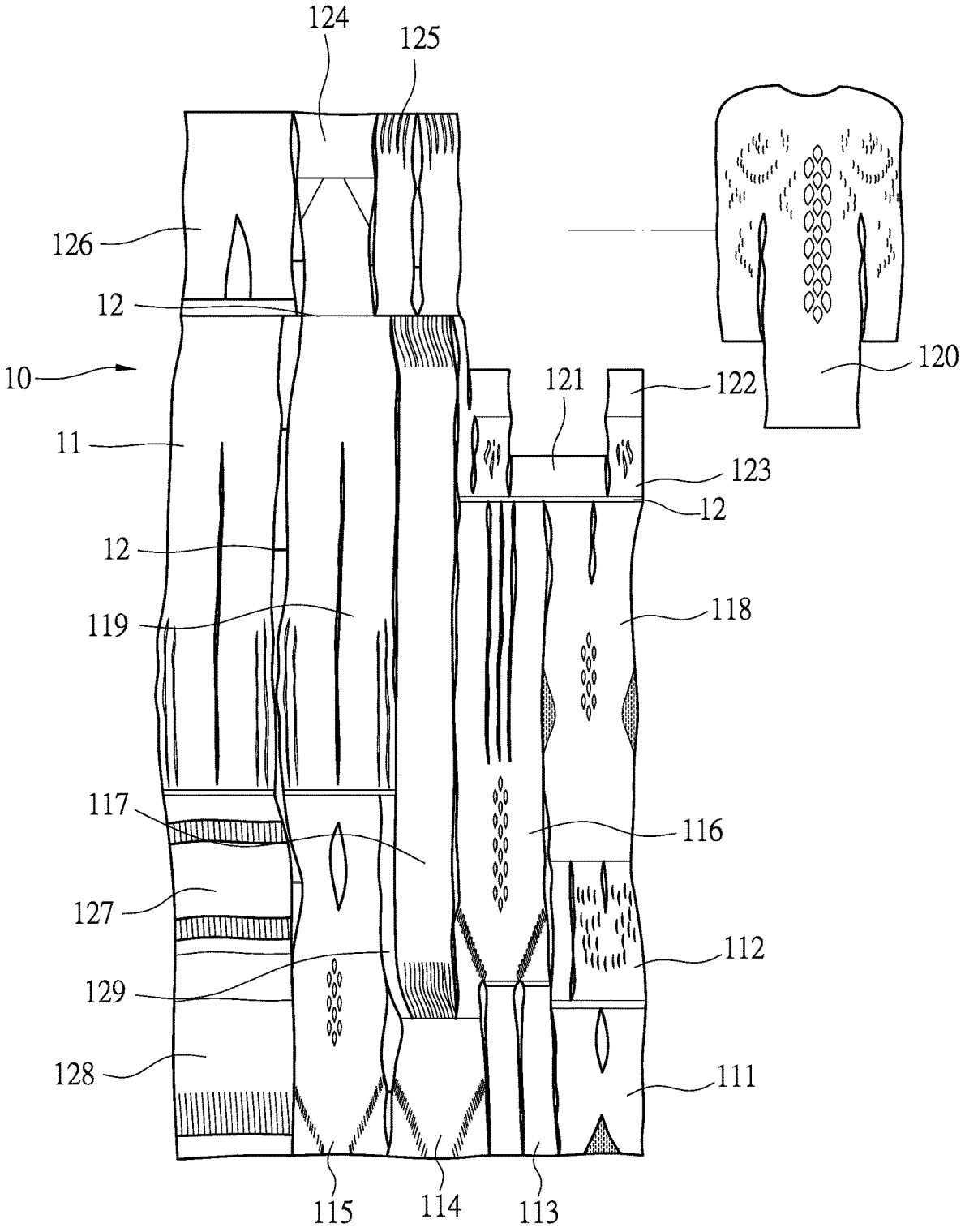
FIG. 2 is a schematic drawing of the fabric being separated according to the present invention.

First, please refer to FIGS. 1-2. A single sheet fabric apparel set for a doll comprises a piece of woven fabric 10.

The piece of woven fabric 10 is a double layered, whole garment stretch cloth having a plurality of apparel items 11, and at least one dividing portion 12 provided between two adjacent apparel items 11. Therefore, each piece of the apparel item 11 can be separated by cutting off the dividing portion 12.

The apparel items 11 can be sport bras 111, handbags 112, socks 113, underwear 114, sleeveless swimwear 115, sleeved-swimwear 116, scarf 117, sleeveless dresses 118, long pants 119, sleeved-dresses 120, headband 121, wristband 122, shoes 123, hats 124, gloves 125, shorts 126, tube top 127, skirt 128, or ribbons 129.

Figure 3:
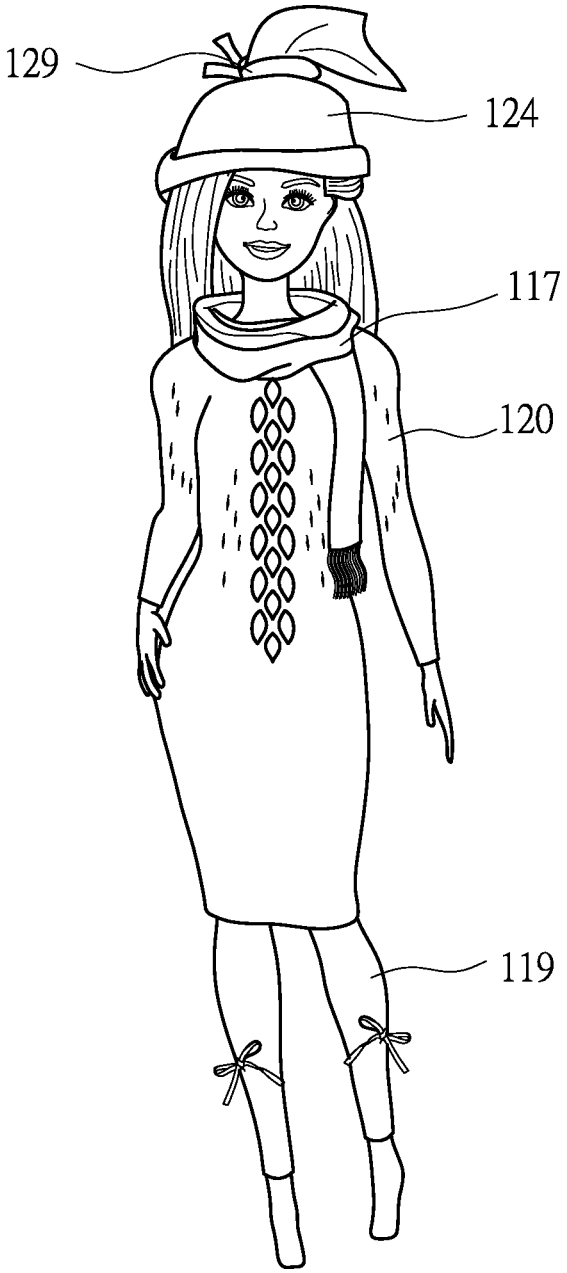
FIG. 3 is a schematic drawing showing styling a doll according to the present invention.
Figure 4:
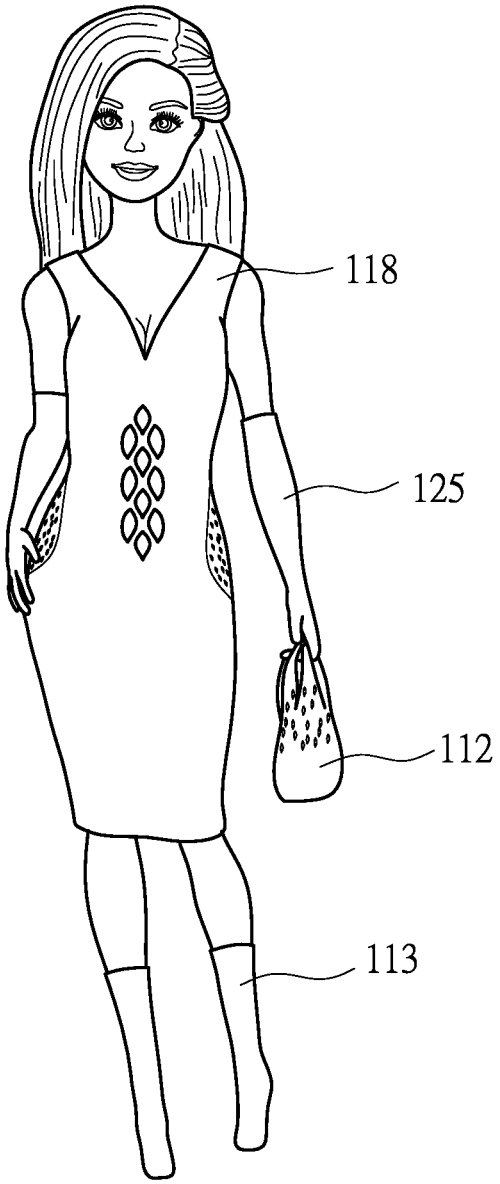
FIG. 4 is another schematic drawing showing styling a doll according to the present invention.
Figure 5:
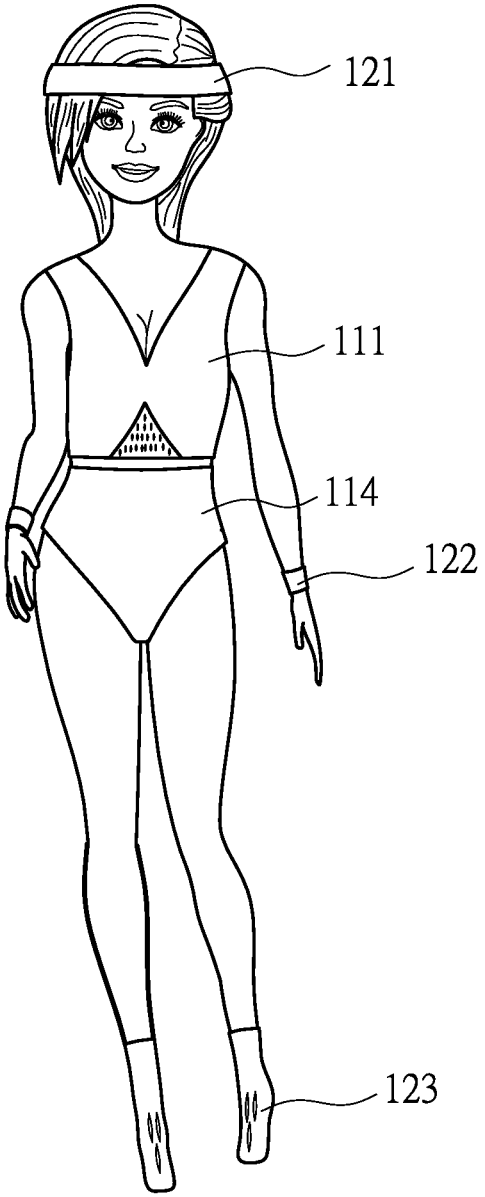
FIG. 5 is another schematic drawing showing styling a doll according to the present invention.
Figure 6:
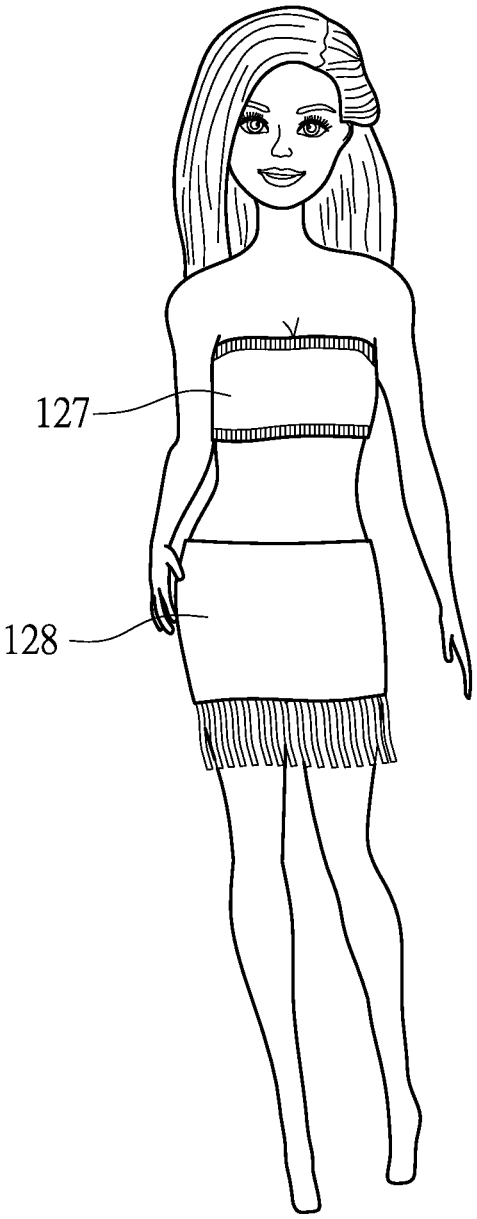
FIG. 6 is another schematic showing styling a doll according to the present invention.
Figure 7:
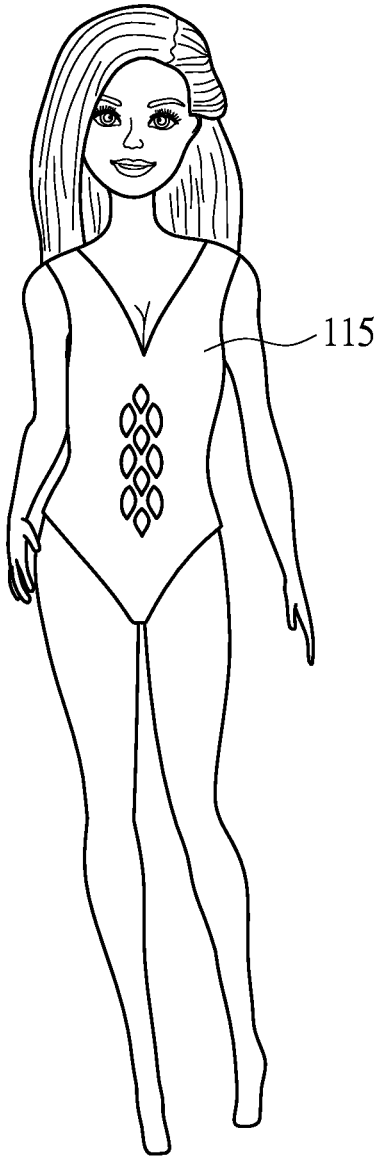
FIG. 7 is another schematic drawing showing styling a doll according to the present invention.

In summary, when actually playing, please refer to FIG. 3 with FIGS. 4 to 7, the piece of woven fabric 10 is cut along the dividing portion 12 to obtain the apparel items 11 in order. Next, since the piece of woven fabric 10 is a double-layer elastic cloth, the apparel item 11 after cutting all respectively has at least one opening, and the elastic apparel item 11 can be stretched and put on toys such as dolls and figurines. Furthermore, the piece of woven fabric is white cloth, which can be colored by children to design and color freely. Through a variety of clothing designing and matching, children can use their brains and hands, to inspire children's imagination and creativity and cultivate creativity and design aesthetics.

In addition, each of the apparel item 11 can be modified to different lengths or slightly different angle, so that the garment can be short sleeves, sleeveless or off-shoulders, or have mesh different cutting on its surface. Many other special shapes can be created for a unique styling design that enhances the fun and durability of toy dressing games.

Figure 8:
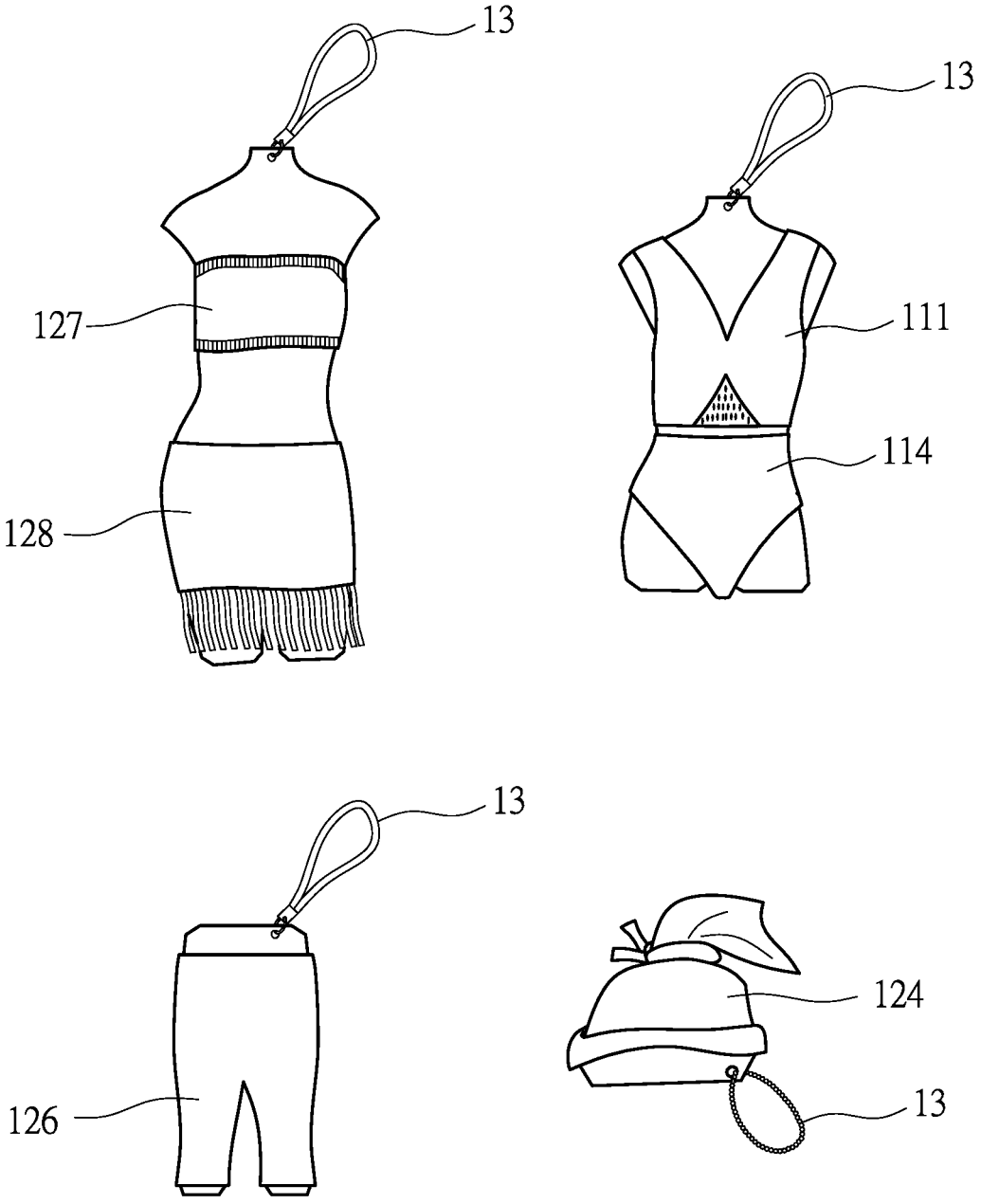
FIG. 8 is a schematic drawing showing the embodiment being attached with a sling or a loop.
Figure 9:
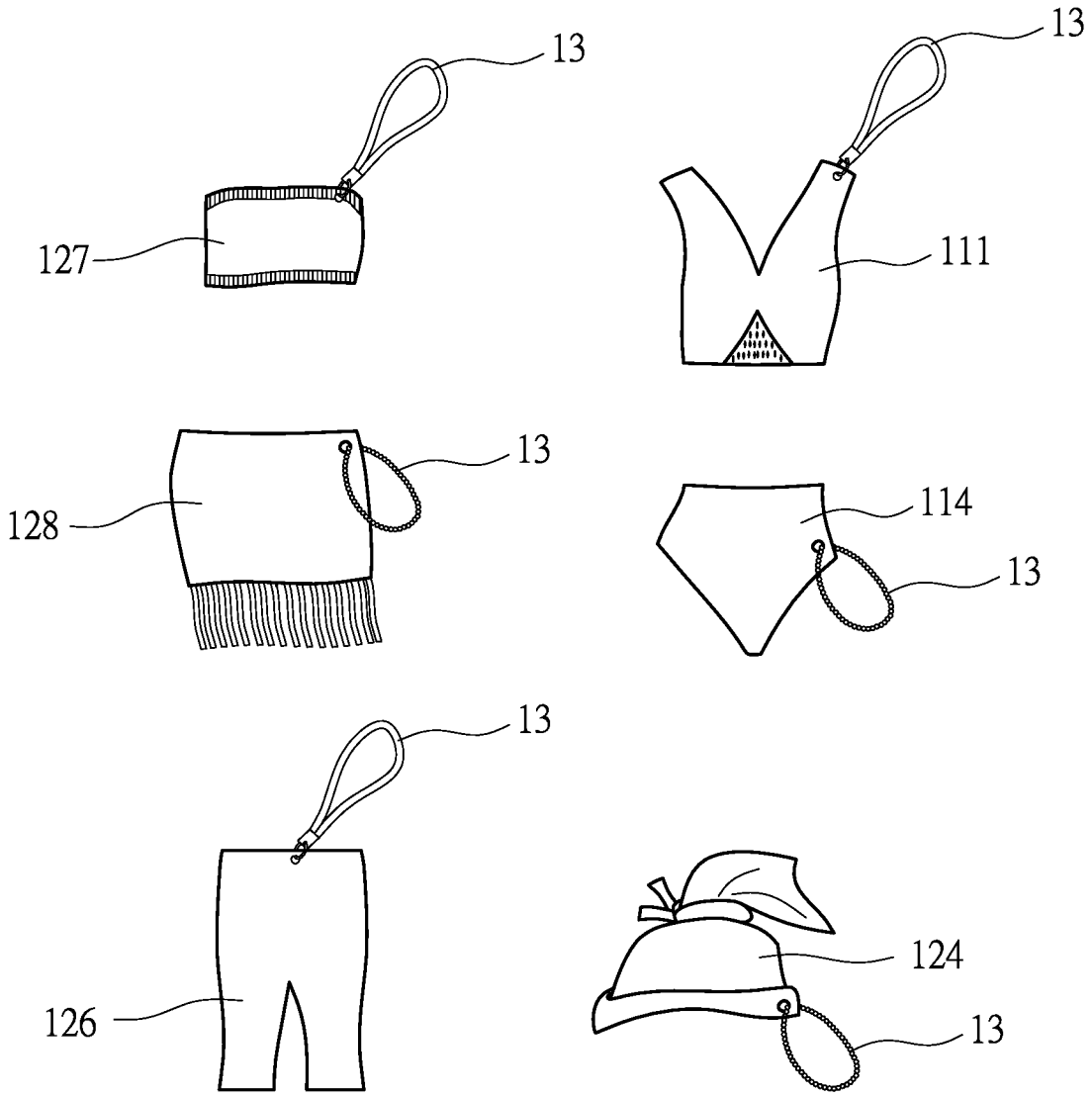
FIG. 9 is a schematic drawing showing the embodiment being attached with a sling or a loop.

Furthermore, the apparel item 11 can be equipped with loop or rings 13 to form small decorative items such as pendants, key rings, and ornament . . . etc. Please refer to FIGS. 8 and 9, The apparel item 11 is put on a board body, the hanging rope or the hanging ring 13 are installed on the board body; or the hanging rope or the hanging ring 13 can also be directly fixed on the apparel item 11 to complete a hanging ornament.

With the structure of the above-mentioned specific embodiment, the following benefits can be obtained: the piece of woven fabric 10 has multiple connected and independently presented the apparel items 11, so that children can choose and follow the dividing portion 12 to cut off the apparel items 11, and then put it on dolls, figurines and other toys to meet children's desire to style and dress freely, and inspire children's imagination and creativity through a variety of clothing combinations clothing and enhance the fun of dress-up games.

Although the present invention has been explained in relation to its preferred embodiment, it is to be understood that many other possible modifications and variations can be made without departing from the spirit and scope of invention as hereinafter claimed.

What is claimed is:

1. A fabric apparel set for a doll comprising a single piece of woven fabric, the single piece of woven fabric being woven as a loop so as to form a double layered, whole garment stretch cloth having a plurality of apparel items, and at least one dividing portion provided between two adjacent apparel items.

2. The single sheet fabric apparel set for a doll as claimed in claim 1, wherein the piece of woven fabric is a white cloth.

3. The single sheet fabric apparel set for a doll as claimed in claim 1, wherein the apparel items comprise sports bras, handbags, socks, underwear, swimwear, scarfs, tops, hats, gloves, shorts, or dresses.

* * * * *